US007497635B1

(12) United States Patent
Bae

(10) Patent No.: US 7,497,635 B1
(45) Date of Patent: Mar. 3, 2009

(54) COSMETIC RECEPTACLE

(75) Inventor: Hae Dong Bae, Anyang (KR)

(73) Assignee: Taesung Industrial Co., Ltd., Anyang, Kyungki-do (KR)

( * ) Notice: Subject to any disclaimer, the term of this patent is extended or adjusted under 35 U.S.C. 154(b) by 0 days.

(21) Appl. No.: 12/017,843

(22) Filed: Jan. 22, 2008

(30) Foreign Application Priority Data

Dec. 6, 2007 (KR) ..... 10-2007-0126117

(51) Int. Cl.
*A46B 11/02* (2006.01)

(52) U.S. Cl. ..... 401/188 R; 401/123

(58) Field of Classification Search ..... 401/188 R, 401/123, 195, 137, 209; 601/112, 113, 72
See application file for complete search history.

(56) References Cited

U.S. PATENT DOCUMENTS 3,910,706 A * 10/1975 Del Bon ..... 401/134

6,948,875 B1 * 9/2005 Jang ..... 401/146

* cited by examiner

*Primary Examiner*—David J Walczak
(74) *Attorney, Agent, or Firm*—Lowe Hauptman Ham & Berner, LLP

(57) ABSTRACT

A cosmetics receptacle includes an upwardly opened cylindrical receptacle part; a receptacle cap assembled to a top portion of the receptacle part; a push button having a button channel, and disposed above the receptacle cap; a cylinder vertically assembled in the receptacle cap and the cylinder has an intermediate storage area connecting to the receptacle part through a storage hole on a bottom surface; a pumping part, which is adapted to dispense cosmetics when the push button is pressed down, and adapted to pull the cosmetics in the receptacle part back into the intermediate storage area through the storage hole when the push button is released; a fixing post part formed on a top portion of the push button, and having a recess; and a massage rod including a head part and a leg part extending from the head part, the massage rod being inserted in the recess.

11 Claims, 12 Drawing Sheets

COSMETIC RECEPTACLE

BACKGROUND OF THE INVENTION

1. Field of the Invention

The present invention relates to a cosmetics receptacle, and more particularly to a cosmetics receptacle in which liquid cosmetics are dispensed by a pumping operation when a push-button is pressed.

2. Description of the Prior Art

In general, marketed liquid cosmetics are stored in a receptacle so that a user can dispense and use a small amount of the stored liquid cosmetics. A conventionally invented and used cosmetics receptacle has a structure where liquid cosmetics are dispensed by a pumping operation when a push-button is pressed.

FIG. 9 is an exploded perspective view illustrating a conventional cosmetics receptacle; and FIG. 10 is a longitudinal sectional view illustrating a conventional cosmetics receptacle.

As shown in FIGS. 9 and 10, a conventional cosmetics receptacle includes: an upwardly opened cylindrical receptacle part 111; a receptacle cap 112 assembled to the top portion of the receptacle part 111; a shoulder part 113 assembled to the top portion of the receptacle cap 112 in such a manner that the shoulder part 113 wraps around the receptacle cap 112; a push button 114 disposed above the receptacle cap 112; a cylinder 115 vertically assembled in the receptacle cap 112; and a pumping part 140 placed between the cylinder 115 and the push button 114.

The receptacle part 111 includes: an outer receptacle 111*c*; an inner receptacle 111*b* provided within the outer receptacle 111*c*; a receptacle piston 111*e* provided in a lower area in the inner receptacle 111*b*; and a support part 111*d* assembled on the bottom surface of the outer receptacle 111*c*.

In the inner receptacle 111*b*, liquid cosmetics are stored.

The receptacle cap 112 has a guide tube 111*a* in the upper portion thereof.

The push button 114 has a right angle button channel 114*a* extending from a bottom surface to a lateral surface, and also has an elevation flange 114*b* and a spring supporting flange 114*c* (which are tube-shaped) on the bottom surface.

The push button 114 as described above is provided in such a manner that the elevation flange 114*b* is in contact with the inner surface of the shoulder part 113.

Accordingly, the push button 114 can be moved in a vertical direction of the receptacle part 111.

The cylinder 115 has a storage hole 115*b* on the bottom surface thereof.

Also, in an inner space of the cylinder 115, an intermediate storage area 115*a* connecting to the inner receptacle 111*b* is formed.

The pumping part 140 includes: a cyclic pumping piston 141 tightly assembled on the inner surface of the cylinder 115; a pressure tube 142 on the bottom surface of the push button 114; a valve body 143 assembled on a circumferential area of the storage hole 115*b*; a return spring 144 assembled between the spring supporting flange 114*c* and the pressure tube 142, in such a manner that both ends of the return spring 144 are supported by the push button 114 and the receptacle cap 112; and an operating shaft 145 penetrating through the pressure tube 142 and the pumping piston 141.

The valve body 143 includes an opening/closing plate 143*a*; a retaining wall 143*b* tightly assembled on the inner surface of the cylinder 115; and an opening/closing arm 143*c* connecting the retaining wall 143*b* with the opening/closing plate 143*a*.

The opening/closing plate 143*a* can close the storage hole 115*b*.

In the valve body 143 as described above, when pressure is added to the opening/closing plate 143*a* through the storage hole 115*b*, the opening/closing plate 143*a* is raised by the opening/closing arm 143*c*, and accordingly the intermediate storage area 115*a* is connected to an inner space of the receptacle part 111.

The operating shaft 145 has an inverted T-shaped passage channel 145*a* inside thereof. The passage channel 145*a* is closed by the pumping piston 141 while the push button 114 is raised.

The operating shaft 145 is assembled to the pressure tube 142 in such a manner that the operating shaft 145 together with the pressure tube 142 can move up and down, and is spaced apart from the pumping piston 141.

Hereinafter, an operation of the pumping part 140 will be described with reference to FIGS. 11 and 12.

When the push button 114 is pressed down, a passage channel 145*a* is exposed in an intermediate storage area 115*a*, and herein, liquid cosmetics in the intermediate storage area 115*a* are dispensed by sequentially passing through the passage channel 145*a*, a pressure tube 142, and a button channel 114*a* (see FIG. 11).

Herein, as the push button 114 is pressed down, an elastic force of a return spring 144 is increased.

Then, when the pressure on the push button 114 is released, the push button 114 is raised and is returned to its original position by the increased elastic force of the return spring 144.

When the push button 114 is raised, an operating shaft 145 is also raised, and the passage channel 145*a* is closed by a pumping piston 141.

Herein, when the operating shaft 145 is raised, negative pressure occurs in the intermediate storage area 115*a*, and thus the liquid cosmetics in an inner receptacle 111*b* flow into the intermediate storage area 115*a* through a storage hole 115*b* (see FIG. 12).

When the liquid cosmetics in the inner receptacle 111*b* flow into the intermediate storage area 115*a*, a receptacle piston 111*e* is raised.

Hereinafter, a method of using a conventional cosmetics receptacle as described above will be described.

First, liquid cosmetics in the receptacle part 111 are dispensed by pressing the push button 114.

Next, the dispensed liquid cosmetics are applied to skin around eyes, etc. by a finger.

Then, the applied liquid cosmetics are rubbed on and absorbed in the skin.

However, in a conventional cosmetics receptacle, the rubbing of the dispensed liquid cosmetics has caused the reducing of the skin absorption rate, and the inconvenience of the application of the liquid cosmetics.

SUMMARY OF THE INVENTION

Accordingly, the present invention has been made to solve the above-mentioned problems occurring in the prior art, and the present invention provides a cosmetics receptacle which is designed for increasing the skin absorption rate and conveniently applying liquid cosmetics to skin.

In accordance with an aspect of the present invention, there is provided a cosmetics receptacle including: an upwardly opened cylindrical receptacle part; a receptacle cap assembled to a top portion of the receptacle part; a push button having a button channel extending from a bottom surface to a lateral surface, and disposed above the receptacle cap so as to be moved in a vertical direction of the receptacle part; a cylinder vertically assembled in the receptacle cap in such a manner that the cylinder has an intermediate storage area connecting to the receptacle part through a storage hole on a bottom surface; a pumping part, which is adapted to dispense cosmetics in the intermediate storage area through the button channel when the push button is pressed down, and adapted to pull the cosmetics in the receptacle part back into the intermediate storage area through the storage hole when the push button is released; a fixing post part formed on a top portion of the push button, and having a recess placed in such a manner that an insertion opening is exposed on a top surface of the fixing post part; and a massage rod including a head part having a massaging surface and a leg part extending from the head part, the massage rod being inserted and fixed in the recess by the leg part.

In order to obtain a skin-improving effect by gold, it is preferable that the head part has a gold-plated layer on a surface thereof.

In order to stably insert and fix the massage rod in the recess, the recess includes an upper fixing groove portion having the insertion opening and straight line-shaped guide grooves in a vertical direction on an inner wall, and a lower fixing groove portion connecting to the upper fixing groove portion, and having a cyclic fixing groove in a circumferential direction on an inner wall; and the leg part has a cyclic fixing protuberance and straight line-shaped guide protuberances on an outer surface in such a manner that the fixing protuberance and the guide protuberances are fitted in the fixing groove and the guide grooves, respectively.

Also, in order to easily insert the massage rod in the recess, it is preferable that the guide grooves are formed over an entire inner wall of the upper fixing groove portion, and the guide protuberances are formed on at least a portion of the leg part.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Hereinafter, an exemplary embodiment of the present invention will be described with reference to the accompanying drawings.

Figure 1:
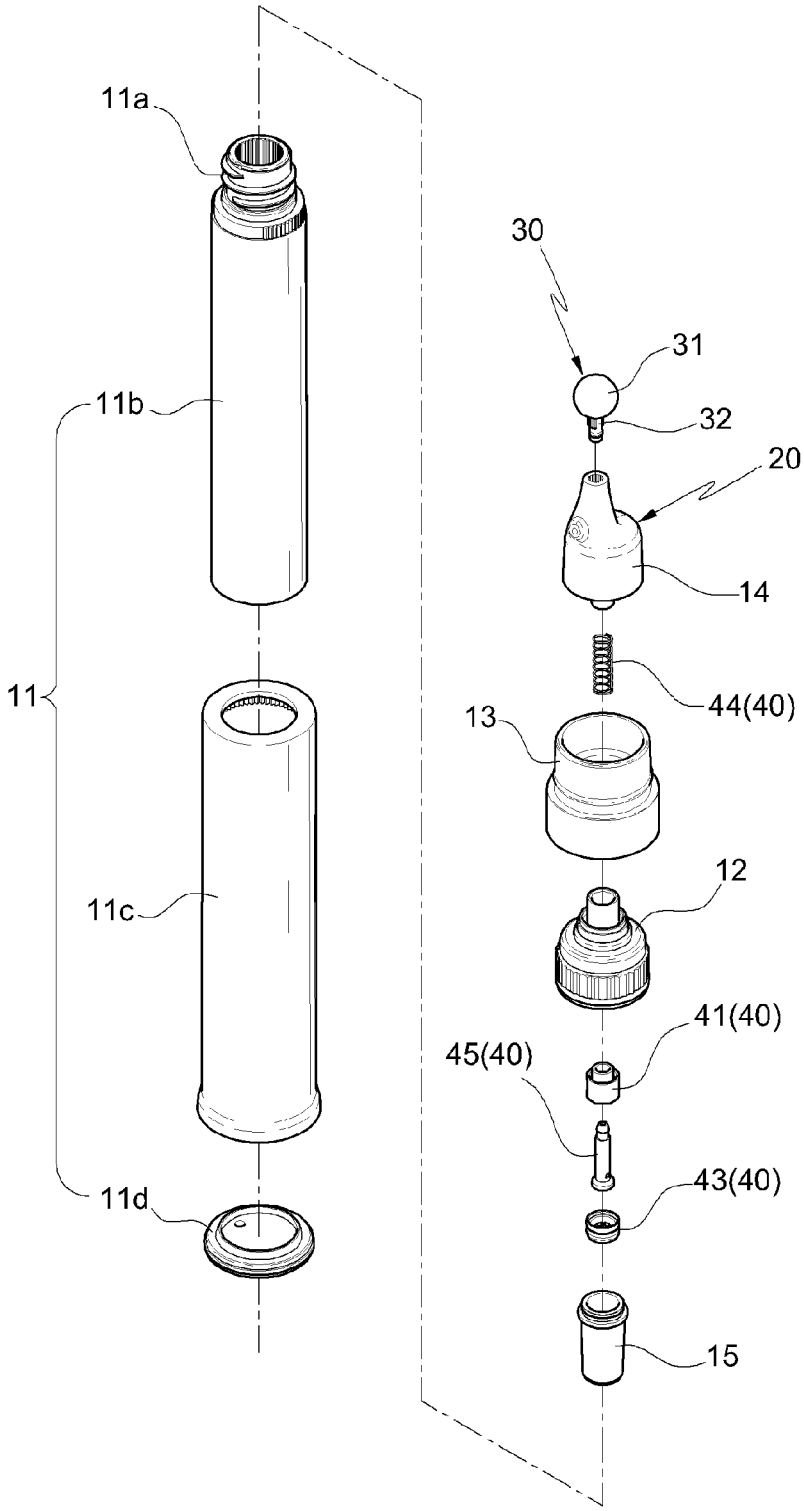
FIG. 1 is an exploded perspective view illustrating a cosmetics receptacle according to an embodiment of the present invention.
Figure 2:
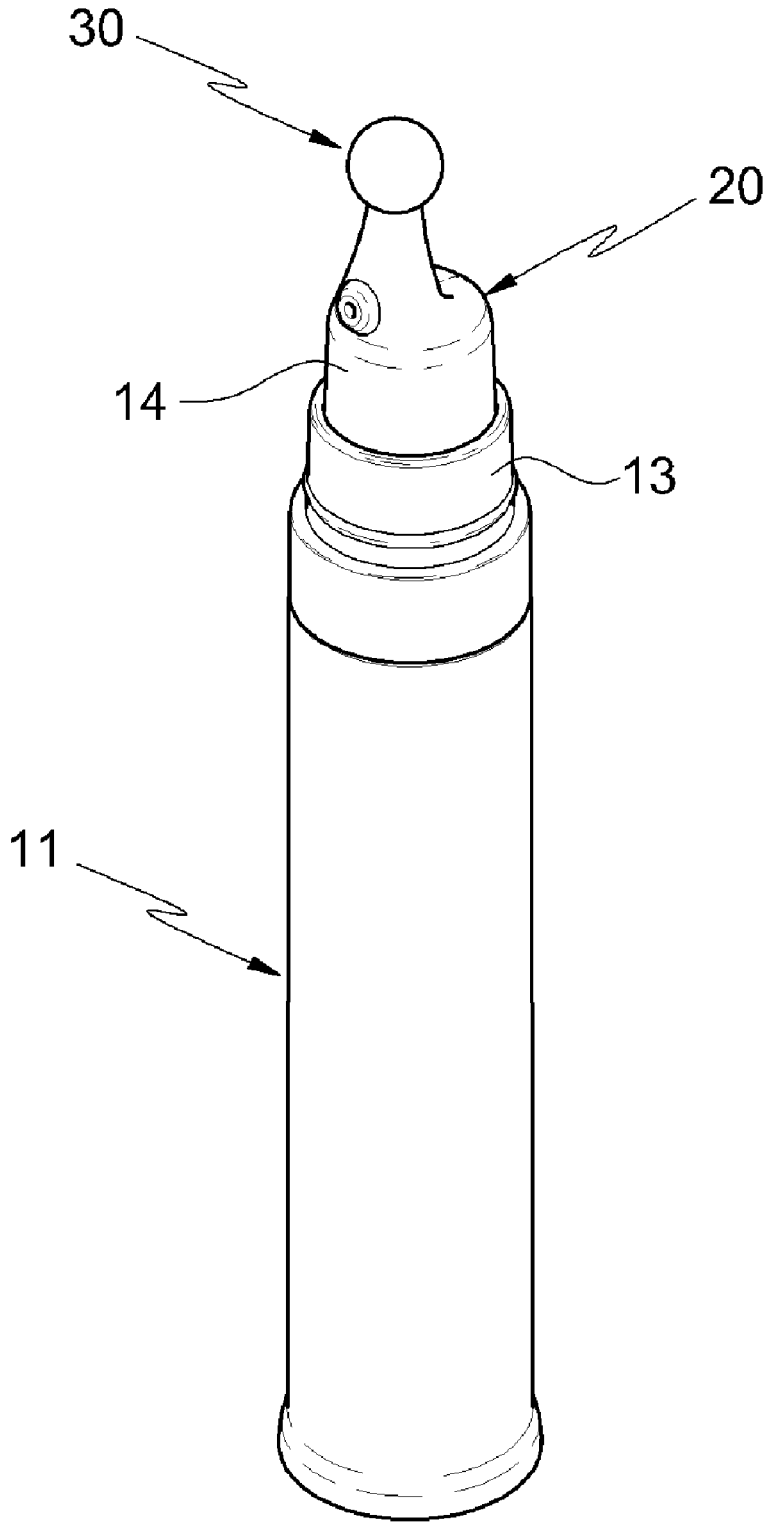
FIG. 2 is a perspective view illustrating a cosmetics receptacle according to an embodiment of the present invention.
Figure 3:
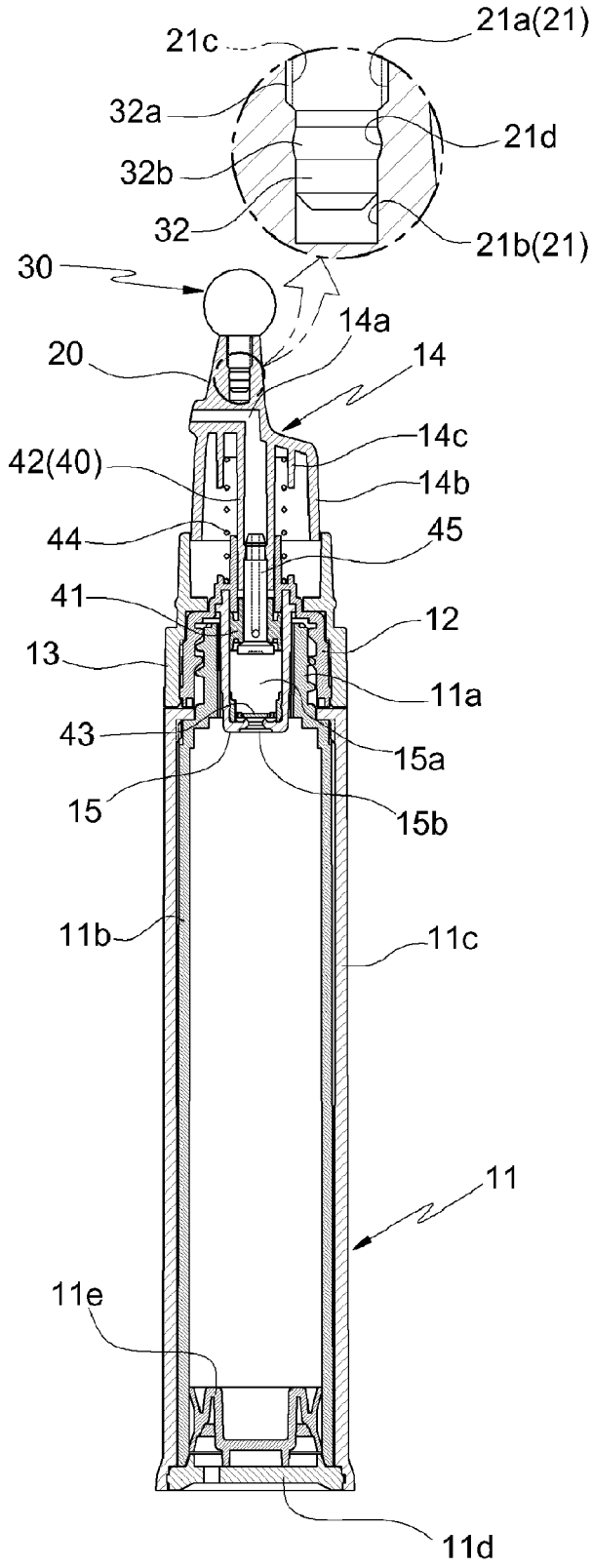
FIG. 3 is a longitudinal sectional view illustrating a cosmetics receptacle according to an embodiment of the present invention.
Figure 4:
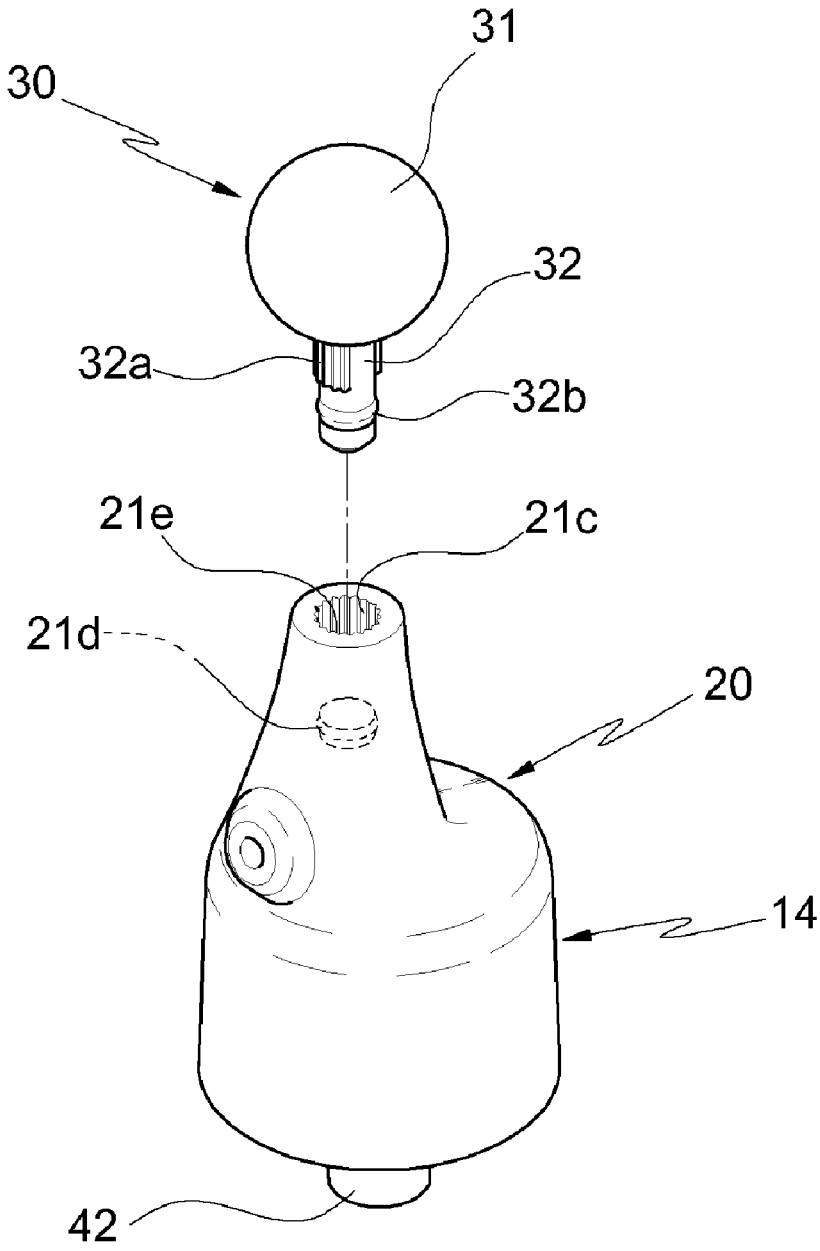
FIG. 4 is an enlarged view illustrating a massage rod and a fixing post part shown in FIG. 1.
Figure 5:
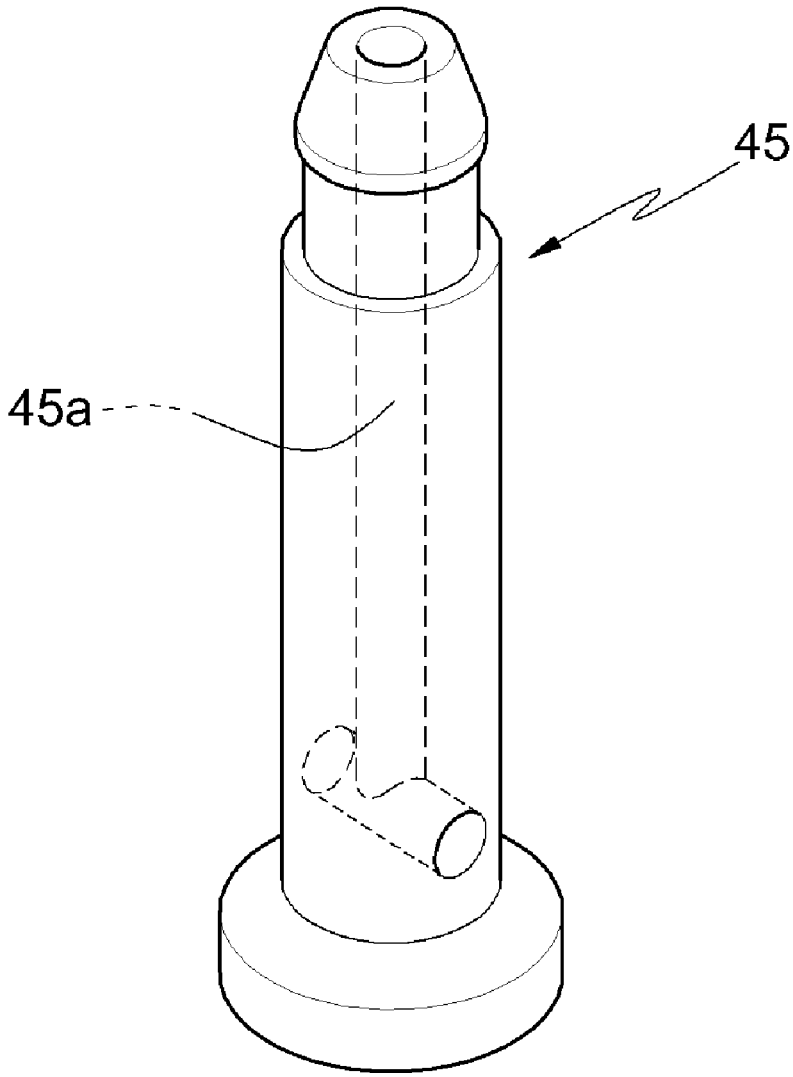
FIG. 5 is an enlarged view of an operating shaft shown in FIG. 1.

FIG. 1 is an exploded perspective view illustrating a cosmetics receptacle according to an embodiment of the present invention; FIG. 2 is a perspective view illustrating a cosmetics receptacle according to an embodiment of the present invention; FIG. 3 is a longitudinal sectional view illustrating a cosmetics receptacle according to an embodiment of the present invention; FIG. 4 is an enlarged view illustrating a massage rod and a fixing post part shown in FIG. 1; and FIG. 5 is an enlarged view of an operating shaft shown in FIG. 1.

As shown in the above FIGs, a cosmetics receptacle according to an embodiment of the present invention includes: an upwardly opened cylindrical receptacle part 11; a receptacle cap 12 assembled to the top portion of the receptacle part 11; a shoulder part 13 assembled to the top portion of the receptacle cap 12 in such a manner that the shoulder part 13 wraps around the receptacle cap 12; a push button 14 disposed above the receptacle cap 12; a fixing post part 20 formed on the top portion of the push button 14; a massage rod 30 fixed in the fixing post part 20; a cylinder 15 vertically assembled in the receptacle cap 12; and a pumping part 40 placed between the cylinder 15 and the push button 14.

The receptacle part 11 includes: an outer receptacle 11*c*; an inner receptacle 11*b* provided within the outer receptacle 11*c*; a receptacle piston 11*e* provided in a lower area in the inner receptacle 11*b*; and a support part 11*d* assembled on the bottom surface of the outer receptacle 11*c*.

In the inner receptacle 11*b*, liquid cosmetics are stored.

The receptacle cap 12 has a guide tube 11*a* in the upper portion thereof.

The push button 14 has a right angle button channel 14*a* extending from a bottom surface to a lateral surface, and also has an elevation flange 14*b* and a spring supporting flange 14*c* (which are tube-shaped) on the bottom surface.

The push button 14 as described above is provided in such a manner that the elevation flange 14*b* is in contact with the inner surface of the shoulder part 13.

Accordingly, the push button 14 can be moved in a vertical direction of the receptacle part 11.

The fixing post part 20 has a recess 21 in such a manner that an insertion opening 21*e* is exposed on the top surface of the fixing post part 20.

The recess 21 includes an upper fixing groove portion 21*a* having the insertion opening 21*e*, and a lower fixing groove portion 21*b* connecting to the upper fixing groove portion 21*a*.

The upper fixing groove portion 21*a* has straight line-shaped guide grooves 21*c* in a vertical direction on an inner wall thereof.

Herein, the guide grooves 21*c* are formed over the entire inner wall of the upper fixing groove portion 21*a*.

The lower fixing groove portion 21*b* has a cyclic fixing groove 21*d* in a circumferential direction on an inner wall thereof.

The massage rod 30 includes a spherical head part 31, and a leg part 32 extending from the head part 31.

The head part 31 has a gold-plated layer on a surface thereof.

The leg part 32 has a cyclic fixing protuberance 32*b* and straight line-shaped guide protuberances 32*a* on the outer surface thereof in such a manner that the fixing protuberance 32*b* and the guide protuberances 32*a* are fitted in the fixing groove 21*d* and the guide grooves 21*c*, respectively.

The guide protuberances 32*a* are divided into two groups, which are formed on opposite areas on the outer surface of the leg part 32.

Hereinafter, a process of fixing the massage rod 30 as described above to the fixing post part 20 will be described.

First, the leg part 32 is inserted in the upper fixing groove portion 21*a* in such a manner that the guide protuberances 32*a* are inserted in the guide grooves 21*c*.

Next, the head part 31 is pressed down toward the bottom surface of the lower fixing groove portion 21*b* in such a manner that the fixing protuberance 32*b* is fitted in the fixing groove 21*d*.

The cylinder 15 has a storage hole 15*b* on the bottom surface thereof.

Also, in an inner space of the cylinder 15, an intermediate storage area 15*a* connecting to the inner receptacle 11*b* is formed.

The pumping part 40 includes: a cyclic pumping piston 41 tightly assembled on the inner surface of the cylinder 15; a pressure tube 42 on the bottom surface of the push button 14; a valve body 43 assembled on a circumferential area of the storage hole 15*b*; a return spring 44 assembled between the spring supporting flange 14*c* and the pressure tube 42, in such a manner that both ends of the return spring 44 are supported by the push button 14 and the receptacle cap 12; and an operating shaft 45 penetrating through the pressure tube 42 and the pumping piston 41.

The valve body 43 includes an opening/closing plate 43*a*; a retaining wall 43*b* tightly assembled on the inner surface of the cylinder 15; and an opening/closing arm 43*c* connecting the retaining wall 43*b* with the opening/closing plate 43*a*.

The opening/closing plate 43*a* can close the storage hole 15*b*.

In the valve body 43 as described above, when pressure is added to the opening/closing plate 43*a* through the storage hole 15*b*, the opening/closing plate 43*a* is raised by the opening/closing arm 43*c*, and accordingly the intermediate storage area 15*a* is connected to an inner space of the receptacle part 11.

The operating shaft 45 has an inverted T-shaped passage channel 45*a* inside thereof. The passage channel 45*a* is closed by the pumping piston 41 while the push button 14 is raised.

The operating shaft 45 is assembled to the pressure tube 42 in such a manner that the operating shaft 45 together with the pressure tube 42 can move up and down, and the pressure tube is spaced apart from the pumping piston 41.

Figure 6:
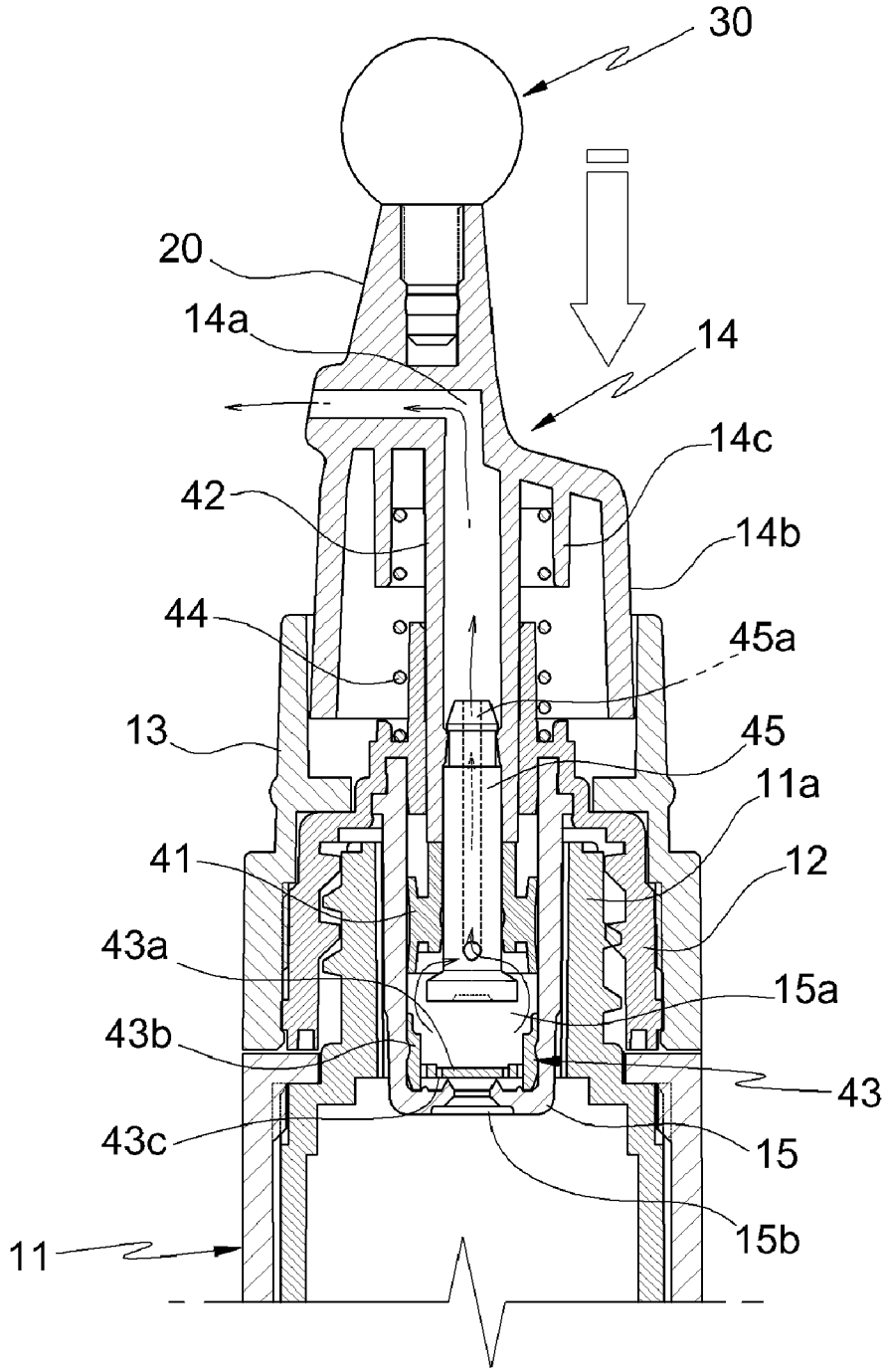
FIGS. 6 and 7 illustrate operations of a pumping part shown in FIG. 1.
Figure 7:
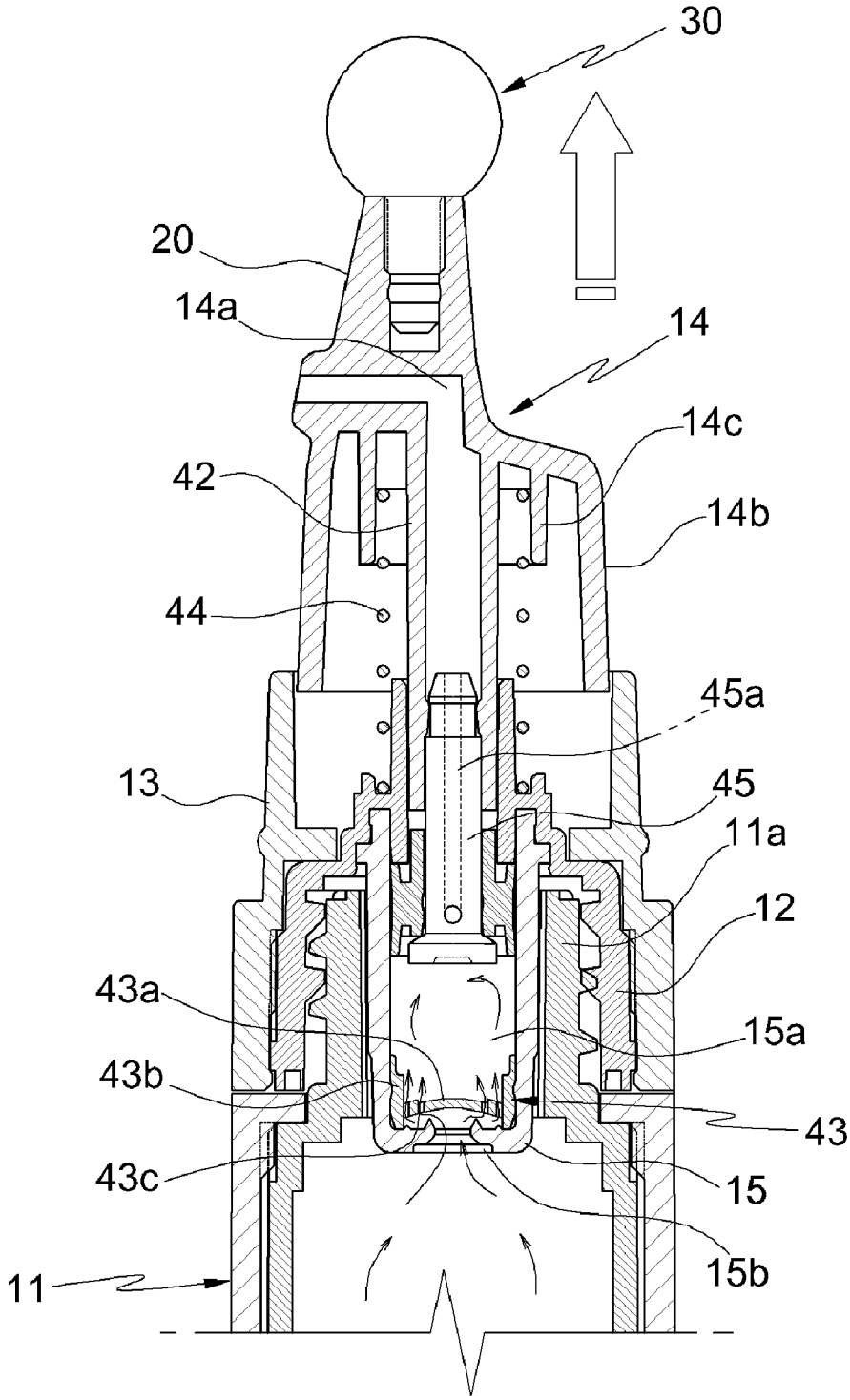

As shown in FIGS. 6 and 7, an operating process of the pumping part 40 as described above is the same as that of a conventional cosmetics receptacle.

Figure 8:
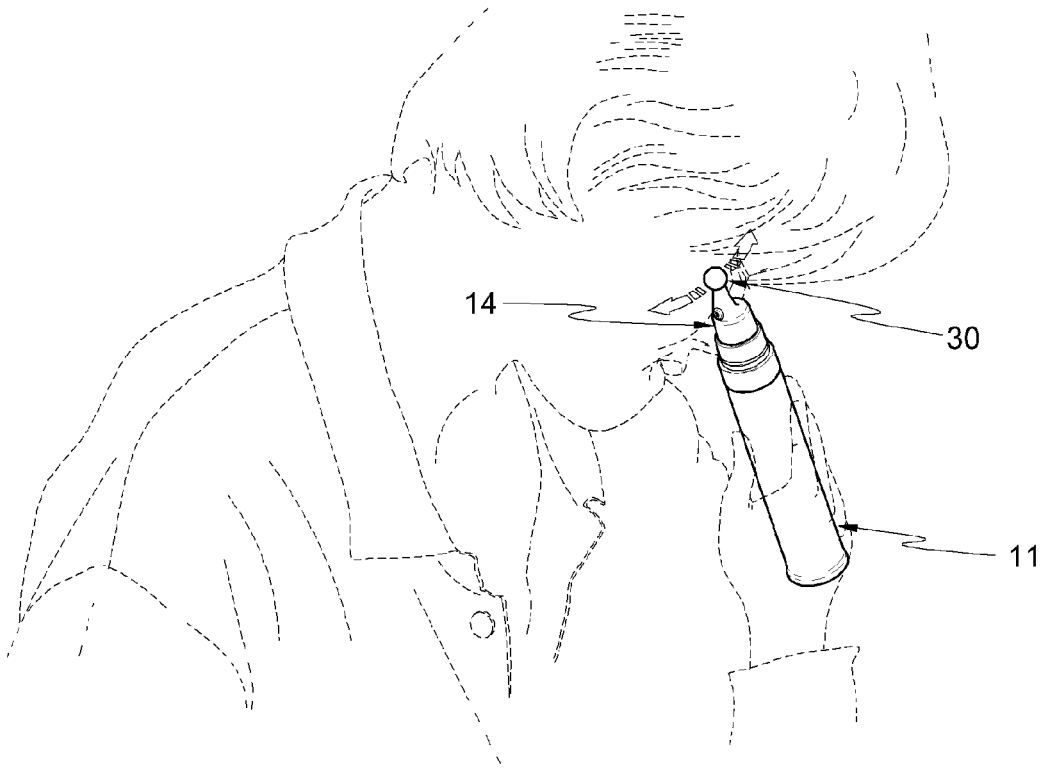
FIG. 8 illustrates a method of using a cosmetics receptacle according to an embodiment of the present invention.
Figure 9:
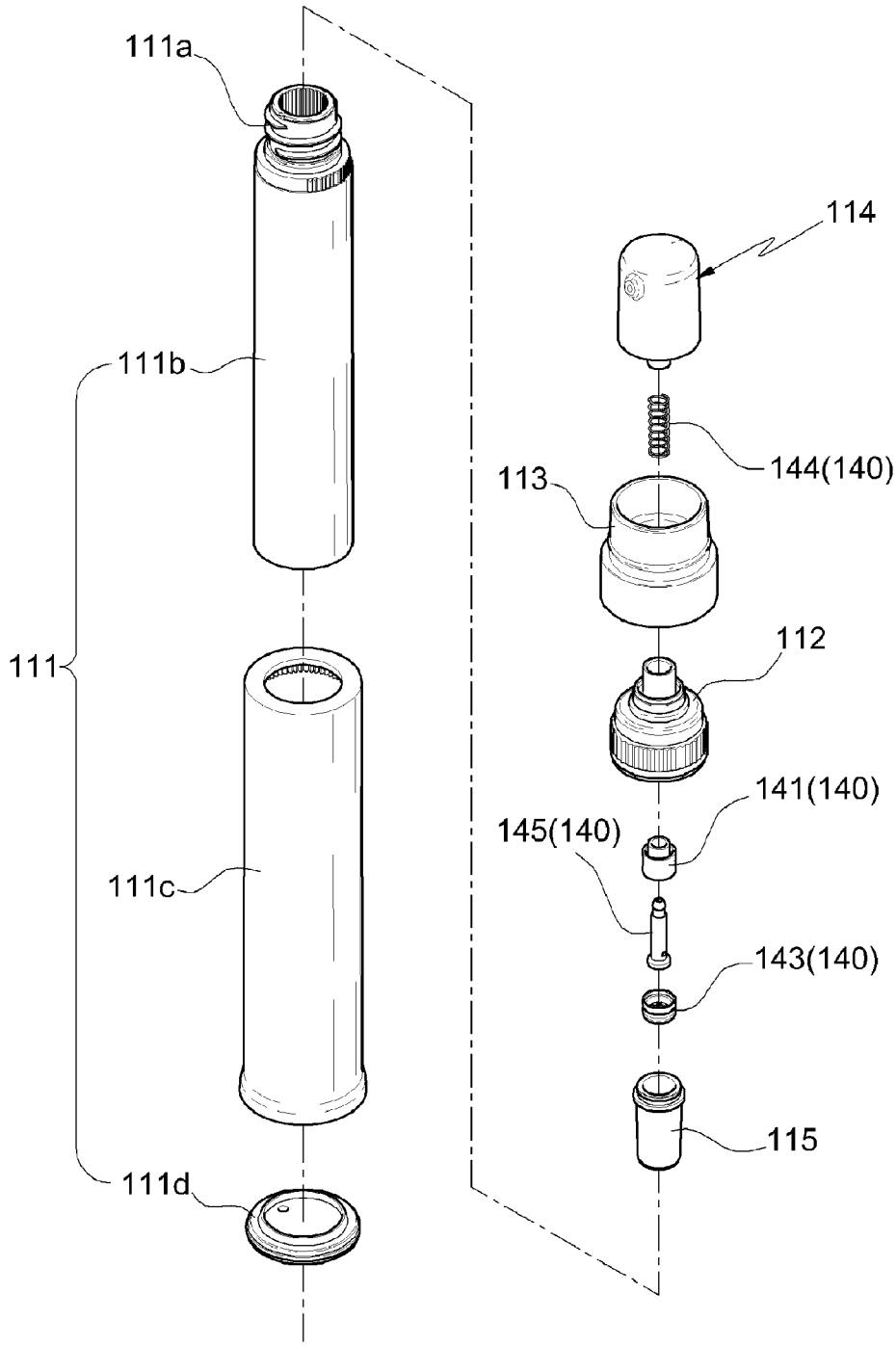
FIG. 9 PRIOR ART
FIG. 9 is an exploded perspective view illustrating a conventional cosmetics receptacle.
Figure 10:
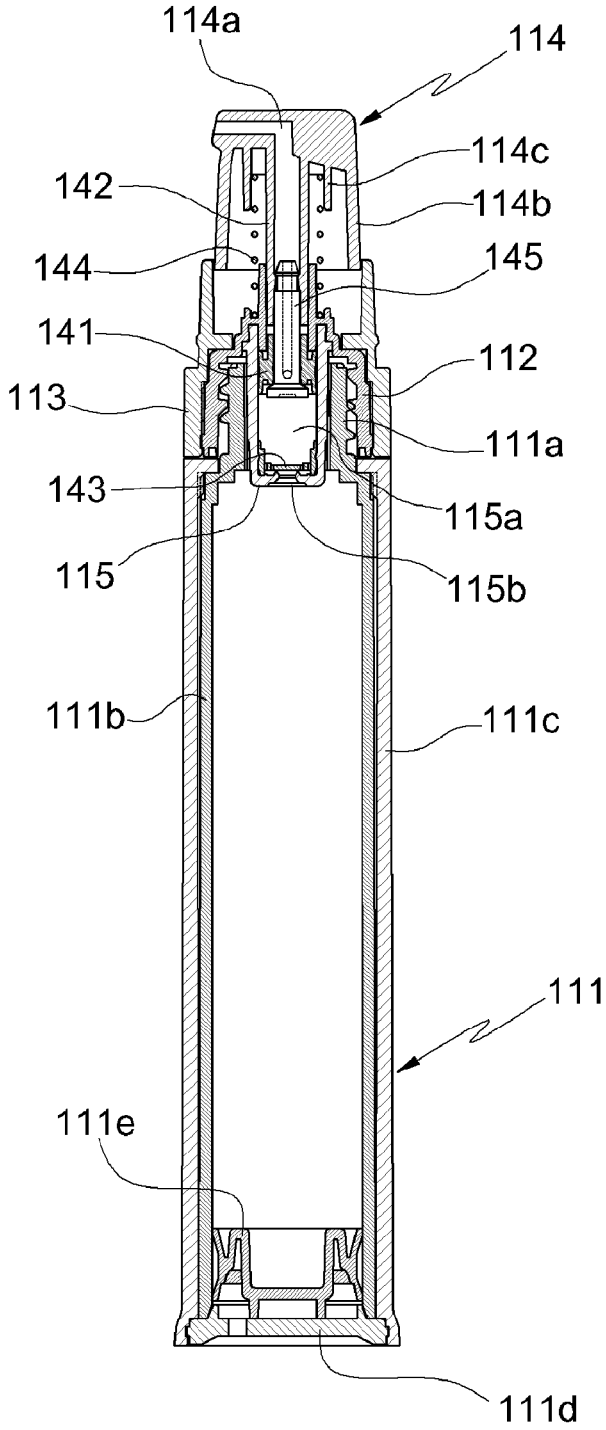
FIG. 10 PRIOR ART
FIG. 10 is a longitudinal sectional view illustrating a conventional cosmetics receptacle.
Figure 11:
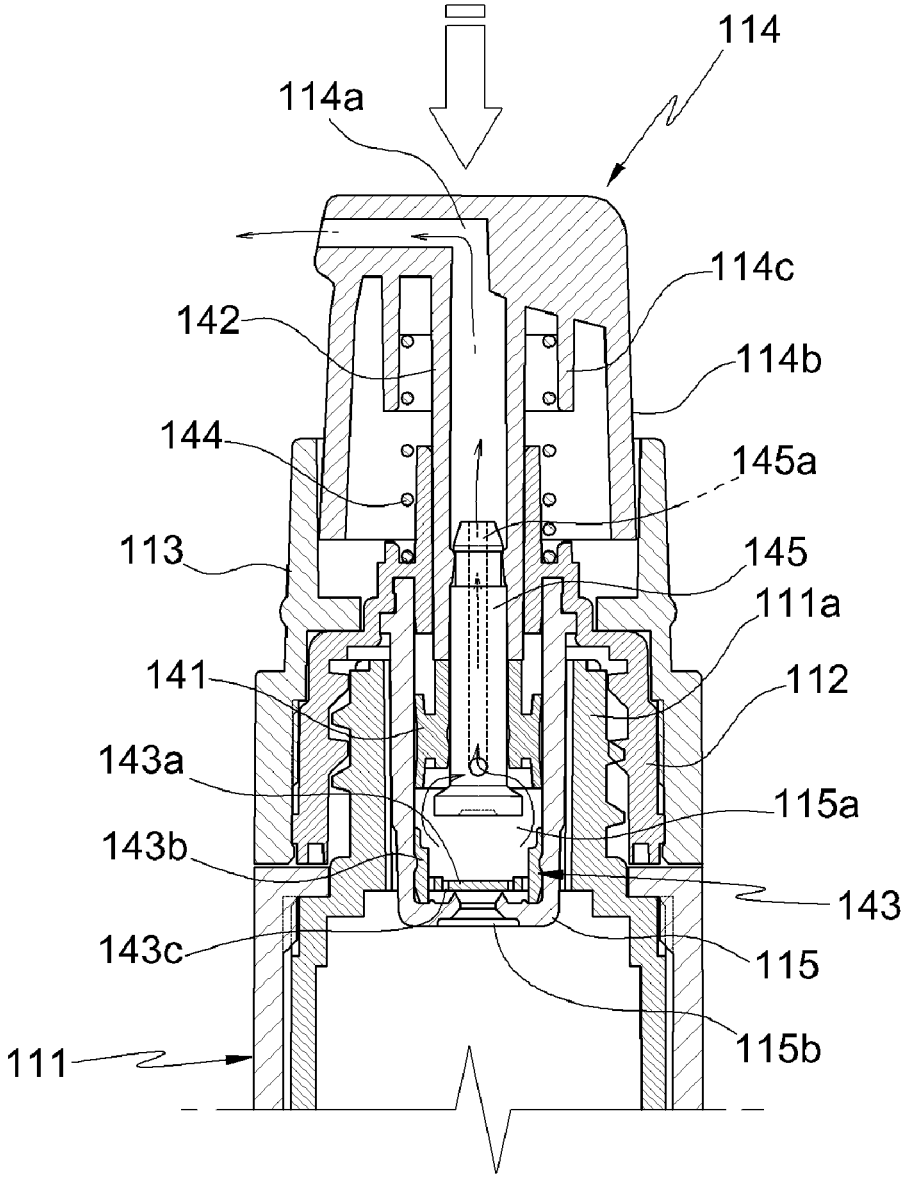
FIG. 11 PRIOR ART
FIGS. 11 and 12 illustrate operations of a pumping part shown in FIG. 9.
Figure 12:
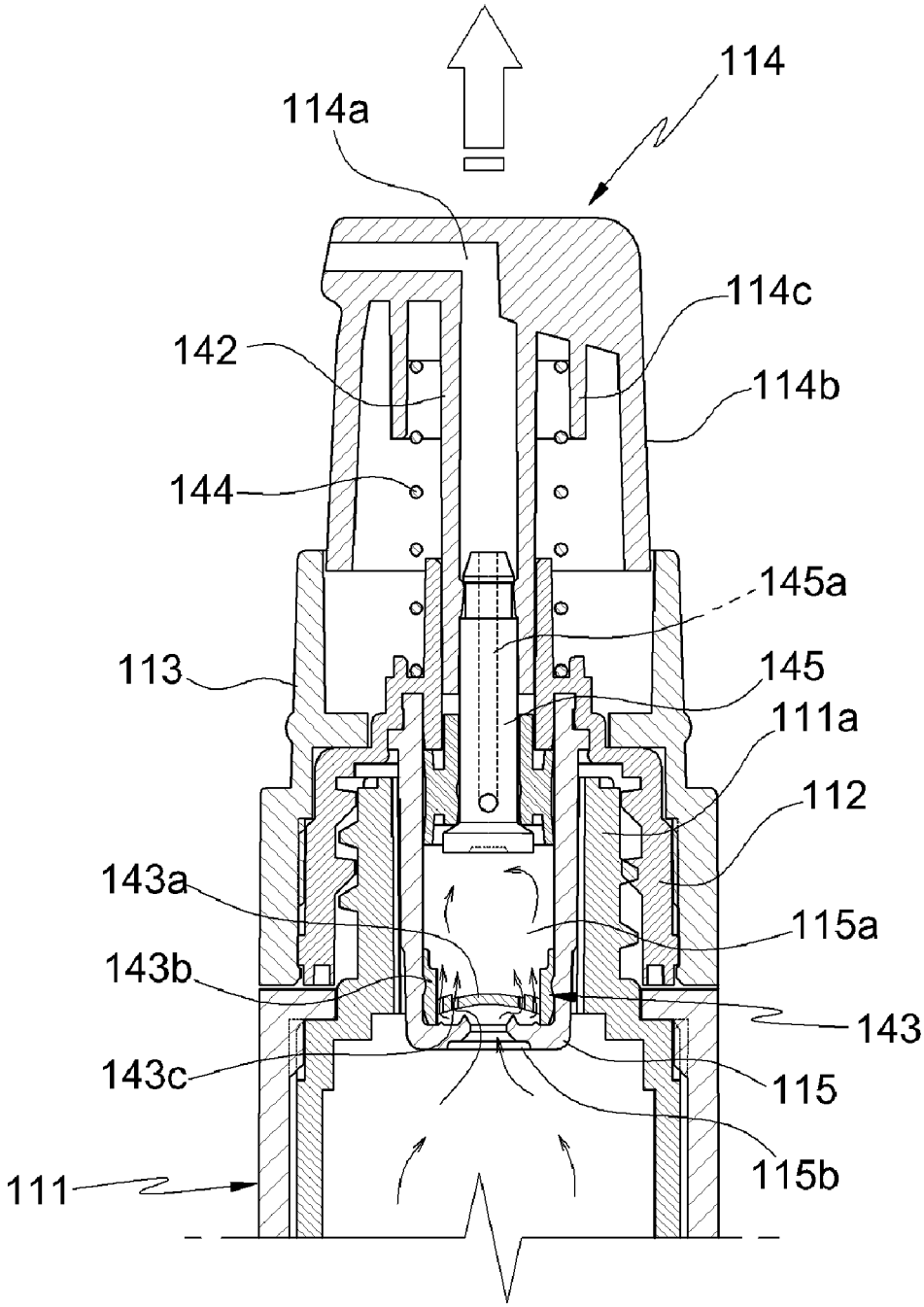
FIG. 12 PRIOR ART

Hereinafter, a method of using a cosmetics receptacle according to an embodiment of the present invention, which has a structure as described above, will be described with reference to FIG. 8.

First, liquid cosmetics in the receptacle part 11 are dispensed by pressing the push button 14.

Next, the dispensed liquid cosmetics are applied to skin around eyes, etc. by a finger.

Then, the applied liquid cosmetics are rubbed into the skin by the head part 31. The rubbing of the head part 31 facilitates the absorption of the liquid cosmetics.

As described above, in an embodiment of the present invention, the fixing post part 20 is formed on the top portion of the push button 14, and the massage rod 30 is fixed in the fixing post part 20. Therefore, it is possible to increase the skin absorption rate and to conveniently apply liquid cosmetics to skin.

In addition, a gold-plated layer formed on the head part 31 provides a massaging effect, and a skin-improving effect by gold (it is conventionally known that gold has various functions of whitening skin, reducing wrinkles, and removing waste inside of skin pores, etc.).

Also, the fixing post part 20 has the guide grooves 21*c* and the fixing groove 21*d*, and the massage rod 30 has the fixing protuberance 32*b* and the guide protuberances 32*a* in such a manner that the fixing protuberance 32*b* and the guide protuberances 32*a* are fitted in the fixing groove 21*d* and the guide grooves 21*c*, respectively. Therefore, the massage rod 30 can be stably inserted and fixed in the recess 21.

Also, the guide grooves 21*c* are formed over the entire inner wall of the upper fixing groove portion 21*a*, the guide protuberances 32*a* are formed on at least a portion of the leg part 32, and thus, the massage rod 30 can be easily inserted in the recess 21.

In the present invention, it should be understood that other modifications and changes, except for the fixing post part 20 and the massage rod 30, may be made within the scope of the claims of the present invention.

According to the present invention, a fixing post part is formed on the top portion of a push button, and a massage rod is fixed in the fixing post part. Therefore, it is possible to increase the skin absorption rate and to conveniently apply liquid cosmetics to skin.

What is claimed is:

1. A cosmetics receptacle comprising:

an upwardly opened cylindrical receptacle part;

a receptacle cap assembled to a top portion of the receptacle part;

a push button having a button channel extending from a bottom surface to a lateral surface, and disposed above the receptacle cap so as to be moved in a vertical direction of the receptacle part;

a cylinder vertically assembled in the receptacle cap in such a manner that the cylinder has an intermediate storage area connecting to the receptacle part through a storage hole on a bottom surface thereof;

a pumping part, which is adapted to dispense cosmetics in the intermediate storage area through the button channel when the push button is pressed down, and adapted to pull the cosmetics in the receptacle part back into the intermediate storage area through the storage hole when the push button is released;

a fixing post part formed on a top portion of the push button, and having a recess placed in such a manner that an insertion opening is exposed on a top surface of the fixing post part; and a massage rod including a head part having a massaging surface with a gold-plated layer thereon and a leg part extending from the head part, the massage rod being inserted and fixed in the recess by the leg part.

2. The cosmetics receptacle as claimed in claim 1, wherein the recess comprises:

an upper fixing groove portion having the insertion opening and straight line-shaped guide grooves in a vertical direction on an inner wall thereof, and a lower fixing groove portion connecting to the upper fixing groove portion, and having a cyclic fixing groove in a circumferential direction on an inner wall thereof; and the leg part has a cyclic fixing protuberance and straight line-shaped guide protuberances on an outer surface in such a manner that the fixing protuberance and the guide protuberances are fitted in the fixing groove and the guide grooves, respectively.

3. The cosmetics receptacle as claimed in claim 2, wherein the guide grooves are configured over an entire inner wall of the upper fixing groove portion, and the guide protuberances are configured on at least a portion of the leg part.

4. The cosmetics receptacle as claimed in claim 2, wherein the guide protuberances are provided on opposite areas on the outer surface of the leg part.

5. The cosmetics receptacle as claimed in claim 1, wherein the push button further comprises a spring supporting flange on the bottom surface thereof and an elevation flange in contact with an inner surface of a shoulder part wrapping around the receptacle cap.

6. The cosmetics receptacle as claimed in claim 5, wherein the spring support flange is tube-shaped.

7. The cosmetics receptacle as claimed in claim 1, wherein the pumping part comprises:

a pumping piston assembled on an inner surface of the cylinder;

a pressure tube located on the bottom surface of the push button;

a valve body assembled on a circumferential area of the storage hole;

a spring supported by the push button and the receptacle cap; and an operating shaft penetrating through the pressure tube and the pumping piston.

8. The cosmetics receptacle as claimed in claim 7, wherein the valve body comprises:

a plate to open or close the storage hole;

a retaining wall tightly assembled on the inner surface of the cylinder; and an arm connecting the retaining wall with the plate.

9. The cosmetics receptacle as claimed in claim 7, wherein the operating shaft comprises an inverted T-shaped passage channel inside thereof.

10. The cosmetics receptacle as claimed in claim 9, wherein the operating shaft is assembled to the pressure tube so as to move the operating shaft with the pressure tube up and down together.

11. The cosmetics receptacle as claimed in claim 10, wherein the pressure tube is spaced apart from the pumping piston.

* * * * *